US010183419B2

(12) United States Patent
Gadd

(10) Patent No.: US 10,183,419 B2
(45) Date of Patent: Jan. 22, 2019

(54) CUTTING APPARATUS

(71) Applicant: DISCO CORPORATION, Tokyo (JP)

(72) Inventor: Michael Gadd, Tokyo (JP)

(73) Assignee: Disco Corporation, Tokyo (JP)

( * ) Notice: Subject to any disclaimer, the term of this patent is extended or adjusted under 35 U.S.C. 154(b) by 613 days.

(21) Appl. No.: 14/573,426

(22) Filed: Dec. 17, 2014

(65) Prior Publication Data

US 2015/0183130 A1 Jul. 2, 2015

(30) Foreign Application Priority Data

Dec. 27, 2013 (JP) ..... 2013-271760

(51) Int. Cl.

| | |
|---|---|
| ***B28D 5/00*** | (2006.01) |
| ***B24B 55/02*** | (2006.01) |
| ***B24B 55/06*** | (2006.01) |
| ***B26D 7/08*** | (2006.01) |
| ***B26D 7/18*** | (2006.01) |
| ***B26D 7/22*** | (2006.01) |
| *B26D 1/14* | (2006.01) |

(52) U.S. Cl.

CPC ..... *B28D 5/0076* (2013.01); *B24B 55/02* (2013.01); *B24B 55/06* (2013.01); *B26D 7/088* (2013.01); *B26D 7/1863* (2013.01); *B26D 7/22* (2013.01); *B28D 5/00* (2013.01); *B26D 1/14* (2013.01); *Y10T 83/207* (2015.04)

(58) Field of Classification Search

CPC ..... B28D 5/0076; B28D 1/04; B28D 5/00; B28D 5/076; B28D 1/04; B24B 55/02; B24B 55/06; B26D 7/088; B26D 7/1863; B26D 7/22

USPC ..... 125/13.01; 451/450, 53

See application file for complete search history.

(56) References Cited

U.S. PATENT DOCUMENTS

| | | | | | |
|---|---|---|---|---|---|
| 4,022,182 | A | * | 5/1977 | Lenkevich | B23D 59/002 125/13.01 |
| 4,619,081 | A | * | 10/1986 | Lipanski | B23D 59/02 125/11.01 |
| 6,095,899 | A | * | 8/2000 | Elmar | B24B 7/228 451/28 |
| 6,105,567 | A | * | 8/2000 | Sun | H01L 21/78 125/13.01 |

(Continued)

FOREIGN PATENT DOCUMENTS

| | | | |
|---|---|---|---|
| JP | 2006-231474 | | 9/2006 |
| JP | 2007216377 | A * | 8/2007 |

*Primary Examiner* — Ghassem Alie
*Assistant Examiner* — Nhat Chieu Do
(74) *Attorney, Agent, or Firm* — Greer Burns & Crain Ltd.

(57) ABSTRACT

A cutting apparatus including a holding unit for holding a workpiece, a cutting blade having a peripheral cutting edge for cutting a workpiece, a spindle unit including a spindle for rotating the cutting blade, a blade cover mounted on the spindle unit for covering the cutting blade, the blade cover having a bottom portion formed with a slit for allowing projection of a part of the cutting edge of the cutting blade, and a cutting fluid supplying unit for supplying a cutting fluid to the upper surface of the workpiece on both sides of the slit. The cutting fluid is not directly supplied to the cutting blade, but it is supplied to the upper surface of the workpiece. Accordingly, there is no possibility that the cutting fluid may be scattered by the rotation of the cutting blade.

2 Claims, 9 Drawing Sheets

(56) References Cited

U.S. PATENT DOCUMENTS

| | | | | |
|---|---|---|---|---|
| 2002/0178883 | A1* | 12/2002 | Yamamoto | B28D 5/0076 83/22 |
| 2008/0153260 | A1* | 6/2008 | Ancheta | B28D 5/0076 438/460 |
| 2008/0163492 | A1* | 7/2008 | Johansson | B23D 59/006 30/124 |

* cited by examiner

CUTTING APPARATUS

BACKGROUND OF THE INVENTION

Field of the Invention

The present invention relates to a cutting apparatus having a blade cover.

Description of the Related Art

In a cutting apparatus having a cutting blade for cutting a workpiece, a cutting fluid is supplied to the cutting blade during cutting, so as to remove process heat (cutting heat) generated due to cutting and also remove cut dust (saw dust or sludge) generated in cutting from the upper surface of the workpiece. In the case that the workpiece is a wafer on which imaging devices such as CMOSs and CCDs are formed or a substrate on which optical devices such as filters and optical pickup devices are formed, there is a possibility that the adhesion of cut dust to the devices may cause poor quality of the devices. Accordingly, great importance is placed on the prevention of the adhesion of cut dust to the devices.

Once cut dust sticks to the upper surface of the workpiece and then dries, it is very difficult to remove the cut dust from the upper surface of the workpiece in a subsequent cleaning step. To cope with this problem, there has been proposed in Japanese Patent Laid-open No. 2006-231474 a cutting apparatus having a mechanism for supplying a cleaning water to the upper surface of a workpiece during cutting to thereby prevent the adhesion of cut dust. This cutting apparatus essentially includes a chuck table for holding a workpiece, cutting means for cutting the workpiece held on the chuck table, cutting water supplying means for supplying a cutting water to a cutting blade, and cleaning water supplying means for supplying a cleaning water to the upper surface of the workpiece in cutting the workpiece held on the chuck table, wherein the cleaning water is sprayed in the same direction as the direction of scattering of the cutting water due to the rotation of the cutting blade, thereby supplying the cleaning water to the upper surface of the workpiece.

SUMMARY OF THE INVENTION

In the case of using such a cutting apparatus to cut the workpiece, the cutting water is supplied toward the cutting blade by the cutting water supplying means. Accordingly, the cut dust generated in cutting the workpiece is partly captured by the cutting water, and the cutting water containing the cut dust may be scattered onto the workpiece in association with the rotation of the cutting blade, causing a problem such that the upper surface of the workpiece is soiled as a whole.

When the cut dust sticks to the upper surface of the workpiece as mentioned above, it is difficult to sufficiently remove the cut dust from the upper surface of the workpiece even by the use of the cleaning water supplying means mentioned above. That is, even when the cleaning water is supplied to the upper surface of the workpiece by the cleaning water supplying means, the flow of the cleaning water supplied to the upper surface of the workpiece may be disturbed by the cutting water scattered onto the workpiece, so that there arises a problem such that an insufficiently cleaned area is left on the workpiece and the cut dust on the workpiece cannot be completely removed.

It is therefore an object of the present invention to provide a cutting apparatus which can reduce the possibility that the cut dust may stick to the workpiece.

In accordance with an aspect of the present invention, there is provided a cutting apparatus including holding means for holding a workpiece; a cutting blade having a peripheral cutting edge for cutting the workpiece held by the holding means; a spindle unit including a spindle for rotating the cutting blade; a blade cover mounted on the spindle unit for covering the cutting blade, the blade cover having a bottom portion formed with a slit for allowing projection of a part of the cutting edge of the cutting blade; and cutting fluid supplying means provided outside the slit in the direction of its width for supplying a cutting fluid to the upper surface of the workpiece; the blade cover being formed with a discharge passage having one end communicating with the slit and the other end communicating with a discharge opening connected to a vacuum source, the discharge passage being located in the bottom portion on the leading side in the rotational direction of the cutting blade; whereby the cutting fluid supplied to the upper surface of the workpiece is sucked through the slit into the discharge passage in association with the rotation of the cutting blade, and next discharged through the discharge opening to the outside of the blade cover.

Preferably, the bottom portion of the blade cover is formed with an air intake passage extending from the slit to the outside of the blade cover in the direction opposite to the rotational direction of the cutting blade.

Preferably, the cutting fluid supplying means includes a plurality of cutting fluid nozzles formed on the bottom portion of the blade cover and a cutting fluid passage having one end connected to the cutting fluid nozzles and the other end connected to a cutting fluid source; the cutting fluid nozzles being so arranged as to form a pair of cutting fluid supply areas extending parallel to the slit on both sides thereof. Preferably, a suction opening is formed at one end of the slit on the extension of the discharge passage.

As described above, the cutting apparatus of the present invention includes the blade cover having the bottom portion formed with the slit for allowing projection of a part of the cutting edge of the cutting blade for cutting the upper surface of the workpiece and also includes the cutting fluid supplying means for supplying a cutting fluid to the upper surface of the workpiece on both sides of the slit. Accordingly, the cutting fluid supplied to the workpiece in cutting the workpiece is not directed to the cutting blade covered with the blade cover, so that there is no possibility that the cutting fluid may be scattered by the rotation of the cutting blade.

Further, the blade cover is formed with the discharge passage having one end communicating with the slit and the other end communicating with the discharge opening connected to the vacuum source. Accordingly, the cutting fluid supplied to the upper surface of the workpiece by the cutting fluid supplying means is attracted to a cutting point where the cutting blade comes into contact with the workpiece by the operation of the vacuum source, thereby performing cooling at this cutting point. At the same time, cut dust generated in cutting the workpiece can be captured by the cutting fluid and immediately discharged from the discharge opening to the outside of the blade cover. Thusly, the cutting fluid containing the cut dust is sucked into the discharge passage and then discharged from the discharge opening, so that it is possible to reduce the possibility that the cut dust may stick to the upper surface of the workpiece.

The bottom portion of the blade cover is formed with the air intake passage extending from the slit to the outside of the blade cover in the direction opposite to the rotational direction of the cutting blade. Accordingly, the cutting fluid containing the cut dust can be stably sucked into the discharge passage of the blade cover by the operation of the vacuum source, and the cutting fluid sucked into the discharge passage can be discharged from the discharge opening to the outside of the blade cover.

The cutting fluid supplying means includes the plural cutting fluid nozzles formed on the bottom portion of the blade cover and arranged so as to extend parallel to the slit on both sides thereof, and also includes the cutting fluid passage having one end connected to the cutting fluid nozzles and the other end connected to the cutting fluid source. Accordingly, it is unnecessary to directly supply the cutting fluid to the cutting blade, but the cutting fluid can be effectively supplied to the cutting point where the cutting blade comes into contact with the workpiece. As a result, scattering of the cutting fluid containing the cut dust toward the upper surface of the workpiece can be prevented and it is therefore possible to prevent that the cut dust may stick to the upper surface of the workpiece.

Further, the suction opening is formed at one end of the slit on the extension of the discharge passage. Accordingly, even when the amount of flow of the cutting fluid is increased or the cut dust has a large size, the cutting fluid containing the cut dust can be efficiently sucked from the suction opening and then discharged from the discharge opening to the outside of the blade cover.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
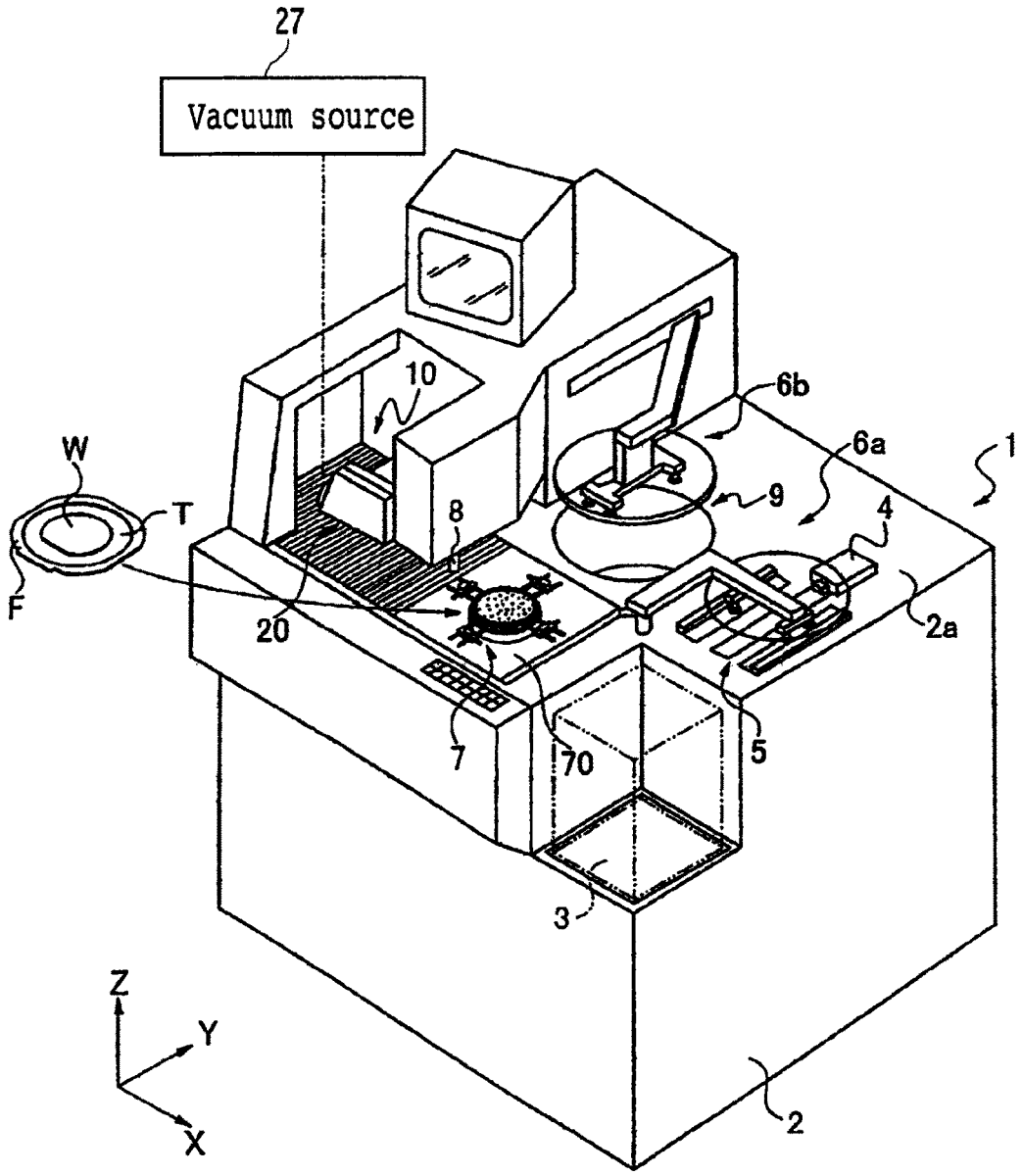
FIG. 1 is a perspective view of a cutting apparatus according to a preferred embodiment of the present invention.

Referring to FIG. 1, there is shown a cutting apparatus 1 according to a preferred embodiment of the present invention. The cutting apparatus 1 has a unit base 2. A cassette 3 for storing a plurality of workpieces is provided at a front portion of the unit base 2. The unit base 2 has an upper surface 2*a*, on which there are provided handling means 4 for taking one of the workpieces out of the cassette 3 before cutting and returning the workpiece into the cassette 3 after cutting, a temporary setting area 5 for temporarily setting the workpiece, and holding means 7 for holding the workpiece. There is provided in the vicinity of the cassette 3 first transfer means 6*a* for transferring the workpiece from the temporary setting area 5 to the holding means 7 before cutting.

The holding means 7 is connected to a vacuum source (not shown) and it is accordingly adapted to hold the workpiece under suction. The periphery of the holding means 7 is covered with a moving base 70. The holding means 7 is movable back and forth with the moving base 70 in the X direction. There are provided along the path of movement of the holding means 7 (in the X direction) imaging means 8 for detecting a subject area of the workpiece to be cut and cutting means 10 for cutting the workpiece. The imaging means 8 has an optical imaging device, which can detect the area for dividing the workpiece into individual devices.

There are provided at a central portion of the unit base 2 a cleaning area 9 for cleaning the workpiece cut by the cutting means 10 and second transfer means 6*b* for transferring the workpiece from the holding means 7 to the cleaning area 9 after cutting.

Figure 2:
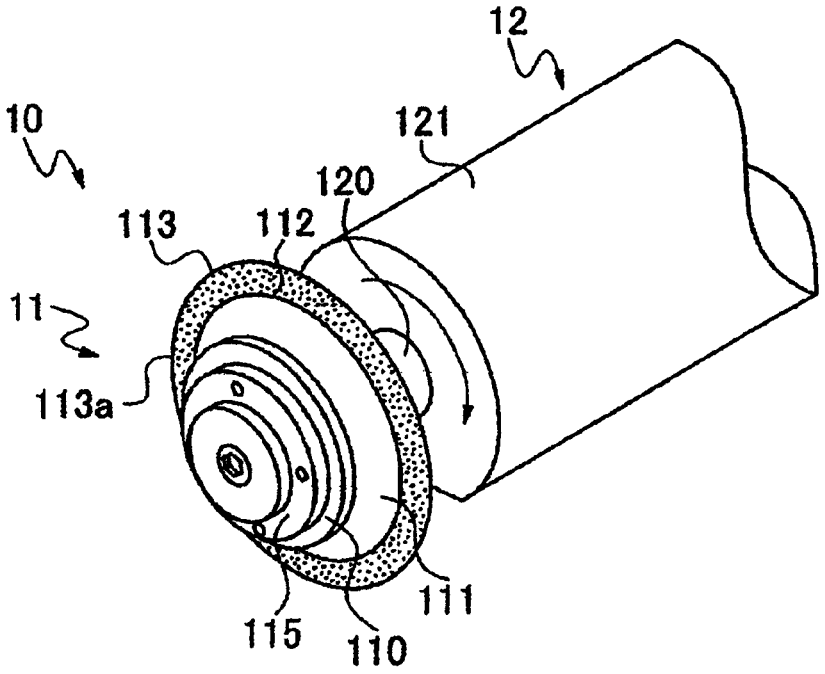
FIG. 2 is a perspective view of cutting means included in the cutting apparatus shown in FIG. 1.

As shown in FIG. 2, the cutting means 10 essentially includes a cutting blade 11 for cutting the workpiece and a spindle unit 12 for rotationally driving the cutting blade 11. The spindle unit 12 essentially includes a rotatable spindle 120 for mounting the cutting blade 11 and a spindle housing 121 for rotatably supporting the spindle 120. The spindle 120 is rotated by a motor (not shown), thereby allowing the rotation of the cutting blade 11 at a predetermined rotational speed.

The cutting blade 11 is composed of a boss portion 110 having a central opening, a tapered portion 111 integrally connected with the boss portion 110, and a cutting edge 113 mounted on the outer circumferential portion 112 of the tapered portion 111. The boss portion 110 and the tapered portion 111 constitute a hub. The cutting blade 11 is fixed to the spindle 120 by a mount fixing unit 115.

Figure 3:
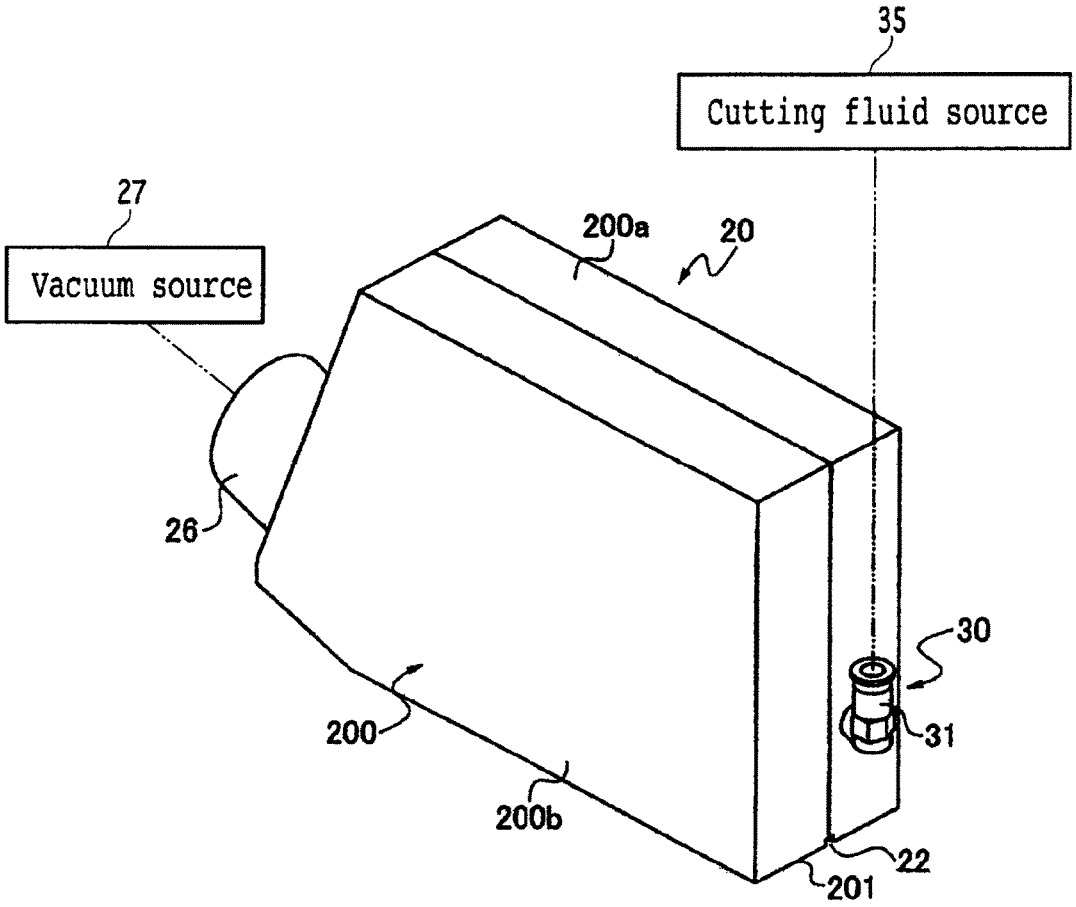
FIG. 3 is a perspective view of a blade cover included in the cutting apparatus shown in FIG. 1.

The cutting apparatus 1 shown in FIG. 1 further includes a blade cover 20 shown in FIG. 3 for rotatably covering the cutting blade 11 and cutting fluid supplying means 30 provided on the blade cover 20 for supplying a cutting fluid to the upper surface of the workpiece. The blade cover 20 has a boxlike cover body 200 for covering the cutting blade 11. The cover body 200 shown in FIG. 3 is composed of a rear cover 200*a* to be mounted on the spindle housing 121 and a front cover 200*b* detachably mounted on the rear cover 200*a* so as to face the front side of the rear cover 200*a*.

Figure 4:
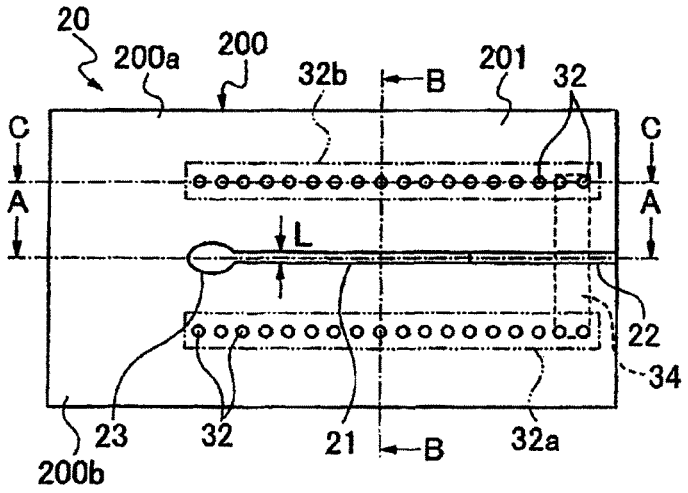
FIG. 4 is a bottom plan view of the blade cover shown in FIG. 3.

The configuration of the blade cover 20 will now be described more specifically. As shown in FIG. 4, the cover body 200 has a bottom portion 201, which is formed with a slit 21 having a predetermined width L in the direction of the thickness of the cutting edge 113 of the cutting blade 11. In the condition where the cutting blade 11 shown in FIG. 2 is accommodated in the cover body 200, a blade tip 113*a* (see FIG. 2) of the cutting edge 113 slightly projects from the slit 21. The width L of the slit 21 is set to a value (e.g., 1 mm or less) slightly larger than the thickness of the blade tip 113*a* of the cutting edge 113.

The bottom portion 201 of the cover body 200 is further formed with an air intake passage 22 communicating with the slit 21. The air intake passage 22 extends from the slit 21 toward the outside of the blade cover 20 in the direction opposite to the rotational direction of the cutting blade 11 (on the upstream side in the rotational direction of the cutting blade 11). More specifically, the air intake passage 22 extends from the slit 21 to one end of the bottom portion 201 of the cover body 200 shown in FIG. 3. In other words, the air intake passage 22 opens at one end of the bottom portion 201.

Figure 5:
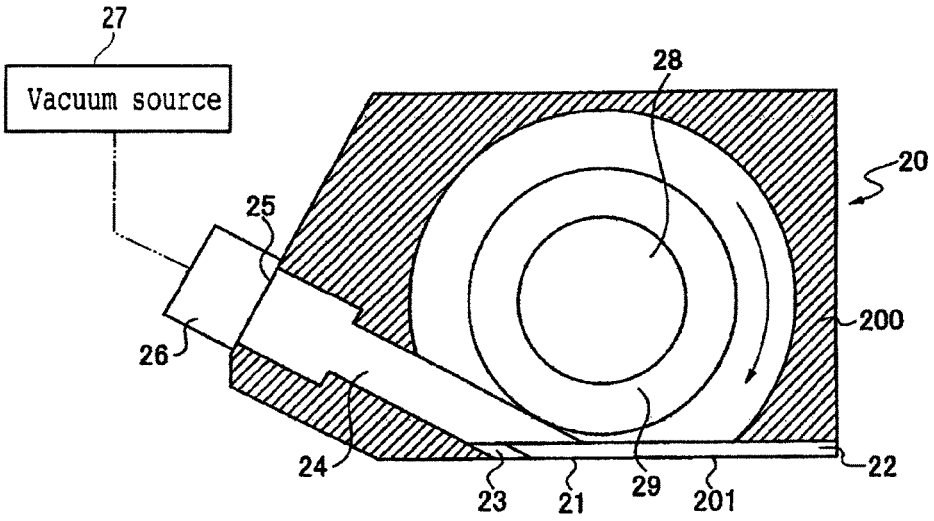
FIG. 5 is a cross section taken along the line A-A in FIG. 4.

As shown in FIG. 5, a discharge passage 24 is formed in the cover body 200 in such a manner that one end of the discharge passage 24 communicates with the slit 21 and the other end of the discharge passage 24 communicates with a vacuum source 27 through a discharge opening 25. The discharge passage 24 is inclined with respect to the bottom portion 201 of the cover body 200 and located on the leading side (downstream side) in the rotational direction of the cutting blade 11 shown in FIG. 2. Further, a pipe 26 is partially inserted through the discharge opening 25 into the discharge passage 24, and the remaining exposed portion of the pipe 26 projects to the outside of the cover body 200. By inserting the pipe 26 into the discharge passage 24, it is possible to prevent air from leaking from the mating surface between the rear cover 200*a* and the front cover 200*b*, causing a reduction in suction pressure.

As shown in FIG. 5, the bottom portion 201 of the cover body 200 is further formed with a suction opening 23 communicating with one end of the slit 21 on the extension of the discharge passage 24. As shown in FIG. 4, the suction opening 23 has a width larger than the width L of the slit 21. While the suction opening 23 is elliptical in shape as shown in FIG. 5, the shape of the suction opening 23 is not limited. By forming the suction opening 23 wider than the slit 21 at one end of the slit 21 as mentioned above, a cutting fluid used in cutting can be efficiently taken into the discharge passage 24.

Figure 6:
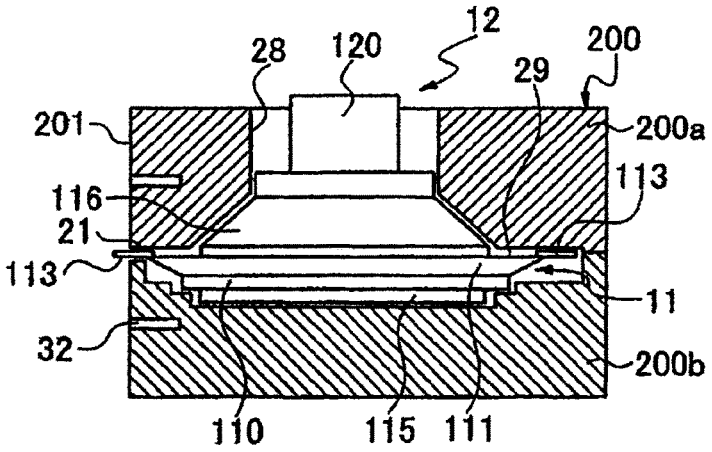
FIG. 6 is a cross section taken along the line B-B in FIG. 4.

As shown in FIG. 6, a mount flange 116 is connected to the front end of the spindle 120 constituting the cutting means 10. The cutting blade 11 is mounted on the mount flange 116 and held between the mount flange 116 and the mount fixing nut 115 threadedly engaged with the front end of the mount flange 116. As shown in FIGS. 5 and 6, a spindle insertion hole 28 is formed in the cover body 200 at its central portion to allow the insertion of the spindle 120. Further, a mount flange accommodating portion 29 communicating with the spindle insertion hole 28 is formed in the cover body 200. The mount flange accommodating portion 29 has a space capable of accommodating the mount flange 116 and the cutting blade 11, wherein the mount flange 116 is connected to the front end of the spindle 120, and the cutting blade 11 is fixed to the mount flange 116 by the mount fixing nut 115. Thus, the blade cover 20 has a configuration such that the cutting edge 113 of the cutting blade 11 partially projects from the slit 21 so as to allow the contact with the workpiece and allow the cutting blade 11 except this projecting part of the cutting edge 113 for being fully covered with the cover body 200.

Figure 7:
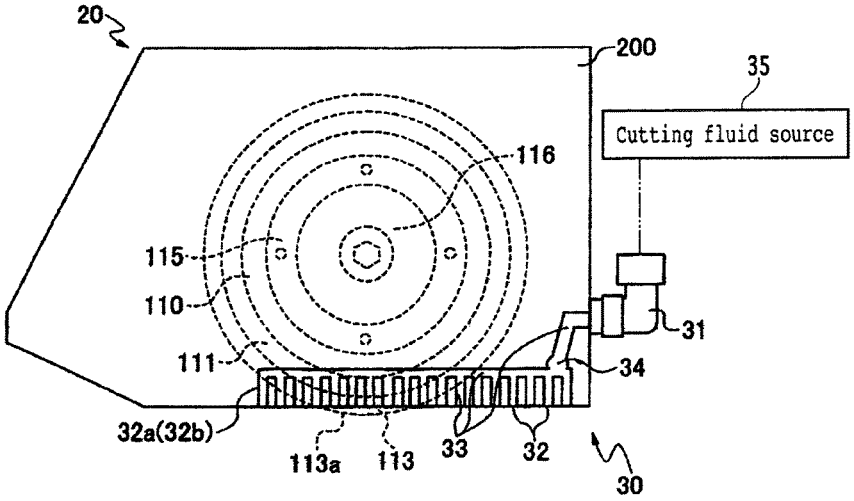
FIG. 7 is a cross section taken along the line C-C in FIG. 4.

As shown in FIG. 7, the cutting fluid supplying means 30 includes a supply member 31 mounted on one end surface of the cover body 200, a plurality of cutting fluid nozzles 32 formed as circular openings on the bottom portion 201 of the cover body 200 shown in FIG. 4, and a cutting fluid passage 33 having one end (composed of plural branched ends) connected to the cutting fluid nozzles 32 and the other end connected through the supply member 31 to a cutting fluid source 35.

As shown in FIG. 4, the plural cutting fluid nozzles 32 are so arranged as to form a pair of cutting fluid supply areas 32*a* and 32*b* extending parallel to the slit 21 on both sides thereof, wherein each of the cutting fluid supply areas 32*a* and 32*b* is composed of the same number of cutting fluid nozzles 32. While each of the cutting fluid supply areas 32*a* and 32*b* is composed of the plural cutting fluid nozzles 32 arranged in a line, each line of cutting fluid nozzles 32 may be replaced by two or more lines of cutting fluid nozzles 32. Further, the number and shape of the cutting fluid nozzles 32 are not limited.

As shown in FIGS. 4 and 7, a connecting passage 34 is formed in the cover body 200 so as to extend in the direction perpendicular to the sheet plane of FIG. 7. The connecting passage 34 is connected to the cutting fluid passage 33, so as to supply the cutting fluid to the two cutting fluid supply areas 32*a* and 32*b* formed on the bottom portion 201 of the cover body 200. As shown in FIG. 3, the supply member 31 is provided on the rear cover 200*a*. In this manner, the supply member 31 is provided on the rear cover 200*a* to configure single external piping from the cutting fluid source 35 to the blade cover 200. That is, the front cover 200*b* is not provided with any external piping. Accordingly, in the case of removing the front cover 200*b* to replace the cutting blade 11, the cutting blade 11 can be easily replaced. That is, the workability of replacement of the cutting blade 11 can be improved.

The operation of the cutting apparatus 1 will now be described. Referring to FIG. 1, a workpiece W is shown as an example of the workpiece to be cut in the present invention. The material etc. of the workpiece W is not limited. Prior to cutting the workpiece W, the workpiece W is preliminarily supported through a tape T to an annular frame F as shown in FIG. 1. Such a plurality of workpieces W are stored in the cassette 3.

First, one of the workpieces W each supported through the tape T to the annular frame F is taken out of the cassette 3 by the handling means 4. The workpiece W thus taken out of the cassette 3 is next set in the temporary setting area 5 by the handling means 4. Thereafter, the workpiece W temporarily set in the temporary setting area 5 is transferred to the holding means 7 by the first transfer means 6*a*. After holding the workpiece W on the holding means 7, the holding means 7 is moved in the X direction to position the workpiece W below the cutting means 10 provided with the blade cover 20. Prior to positioning the workpiece W below the cutting means 10, the workpiece W held on the holding means 7 is imaged by the imaging means 8 to detect a subject area to be cut.

In the condition where the workpiece W held on the holding means 7 is positioned below the cutting means 10 provided with the blade cover 20, the spindle 120 shown in FIG. 2 is rotated to thereby rotate the cutting blade 11 at a predetermined rotational speed. Thereafter, the cutting means 10 is lowered in the Z direction to cut the upper surface of the workpiece W with the cutting edge 113 of the cutting blade 11.

In cutting the workpiece W, the cutting fluid supplying means 30 shown in FIG. 3 is operated to supply a cutting fluid from the cutting fluid source 35 to the supply member 31. The cutting fluid is further supplied from the supply member 31 through the connecting passage 34 to the cutting fluid passage 33 and then sprayed from all of the cutting fluid nozzles 32 toward the upper surface of the workpiece W. The cutting blade 11 is fully covered with the blade cover 20 in the condition where the cutting edge 113 partially projects from the slit 21, and the cutting fluid nozzles 32 are formed so as to be spaced from the slit 21. Accordingly, the cutting fluid sprayed from the cutting fluid nozzles 32 is prevented from being directed toward the cutting edge 113 of the cutting blade 11.

Figure 8:
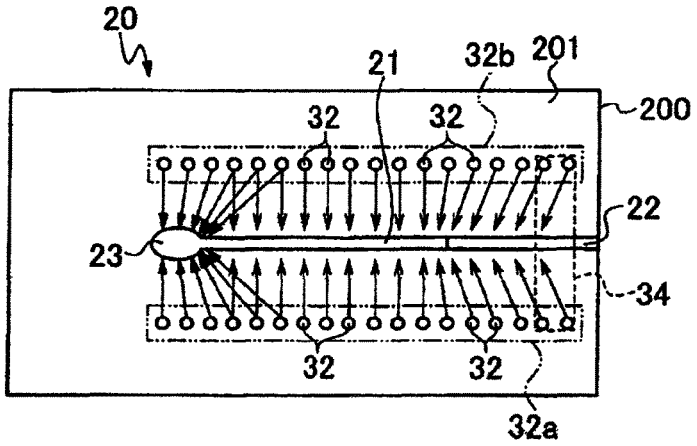
FIG. 8 is a bottom plan view of the blade cover, illustrating the directions of flow of a cutting fluid below the blade cover.

Thus, the cutting fluid supplying means 30 is so configured as not to directly supply the cutting fluid to the cutting blade 11 being rotated. Accordingly, the cutting fluid is prevented from scattering around the cutting blade 11 due to the rotation thereof. Although the cutting fluid is not directly supplied to the cutting blade 11, the cutting fluid is supplied from the plural cutting fluid nozzles 32 in the pair of cutting fluid supply areas 32*a* and 32*b* to the upper surface of the workpiece W. Further, since the suction force generated by the vacuum source 27 shown in FIG. 5 is applied to the discharge passage 24 and the suction opening 23, the cutting fluid sprayed from the plural cutting fluid nozzles 32 to the upper surface of the workpiece W is attracted toward the slit 21 and the suction opening 23 as shown in FIG. 8. Accordingly, the cutting fluid is collected to a cutting point where the cutting blade 11 comes into contact with the workpiece W, thereby cooling the area being cut at this cutting point. Further, the cutting fluid collected to the suction opening 23 by the suction force from the vacuum source 27 is sucked into the discharge passage 24 and then discharged from the discharge opening 25 to the outside of the blade cover 20.

Figure 9:
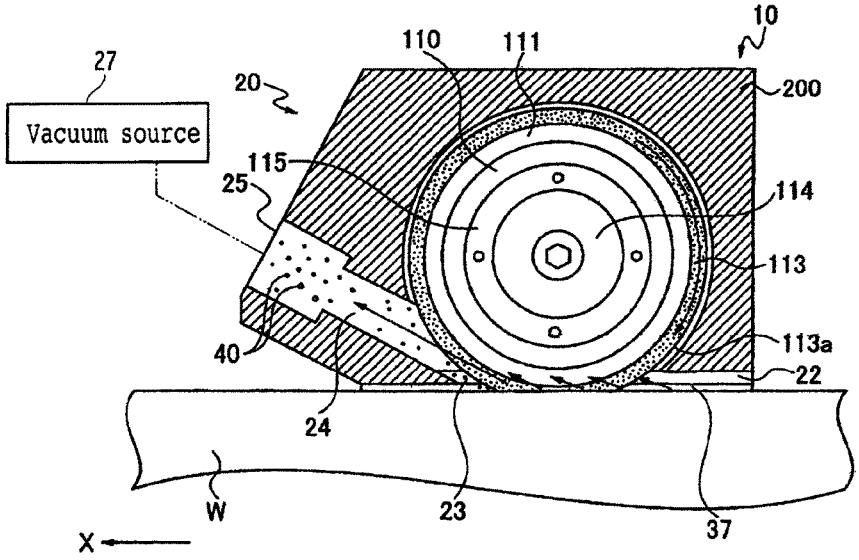
FIG. 9 is a sectional view showing a cutting operation.

As shown in FIG. 9, the workpiece W is moved in the direction shown by an arrow X relative to the cutting means 10, and the upper surface of the workpiece W is cut by the cutting edge 113. During this cutting operation, a cutting fluid 37 supplied to the upper surface of the workpiece W once stays on the upper surface of the workpiece W and next easily flows in the rotational direction of the cutting edge 113 rotating in the blade cover 20. Accordingly, the cutting fluid 37 containing cut dust (saw dust or sludge) 40 generated in cutting the workpiece W is easily discharged through the slit 21 and the suction opening 23 to the discharge passage 24.

At this time, air is taken from the air intake passage 22 toward the cutting edge 113 rotating in the blade cover 20, so that the suction force generated by the vacuum source 27 can stably act in the discharge passage 24, thereby reliably sucking the cutting fluid 37 into the discharge passage 24.

Further, even when the amount of flow of the cutting fluid 37 to be supplied to the upper surface of the workpiece W is increased, the cutting fluid 37 can be efficiently sucked from the suction opening 23 having a relatively large size. Further, even in the case that the size of the cut dust 40 is larger than the width of the slit 21 shown in FIG. 8, the cut dust 40 can be passed through the suction opening 23 provided that the size of the cut dust 40 is smaller than the size of the suction opening 23, so that clogging of the slit 21 with the cut dust 40 can be prevented. In this manner, the cut dust 40 generated in cutting the workpiece W is discharged together with the cutting fluid 37 from the discharge opening 25 to the outside of the blade cover 20.

After finishing the cutting of the workpiece W, the workpiece W is transferred from the holding means 7 to the cleaning area 9 by operating the second transfer means 6*b* shown in FIG. 1. In the cleaning area 9, the workpiece W is cleaned. Thereafter, the workpiece W is transferred from the cleaning area 9 to the temporary setting area 5 by operating the first transfer means 6*a*. In the temporary setting area 5, the workpiece W is temporarily set in position. Thereafter, the workpiece W is stored into the cassette 3 by operating the handling means 4.

According to the cutting apparatus 1 as described above, the cutting blade 11 is fully covered with the blade cover 20 except that part of the cutting edge 113 of the cutting blade 11 projects from the slit 21, and the cutting fluid 37 supplied to the upper surface of the workpiece W is sucked to reach the cutting point where the cutting edge 113 comes into contact with the workpiece W. The cutting fluid 37 used in cutting the workpiece W is sucked through the slit 21 to the discharge passage 24 by the suction force generated by the vacuum source 27, and is then discharged from the discharge opening 25 to the outside of the blade cover 20. Accordingly, it is unnecessary to directly spray the cutting fluid 37 toward the cutting blade 11, so that scattering of the cutting fluid 37 containing the cut dust 40 can be prevented. Further, since the cutting fluid 37 containing the cut dust 40 can be discharged from the discharge opening 25 to the outside of the blade cover 20 by the suction force generated by the vacuum source 27, it is possible to reduce the possibility that the cut dust 40 may stick to the upper surface of the workpiece W.

The cutting fluid supplying means 30 includes the plural cutting fluid nozzles 32 formed on the bottom portion 201 of the blade cover 20 in such a manner that the plural cutting fluid nozzles 32 are so arranged as to extend parallel to the slit 21 on both sides thereof, and also includes the cutting fluid passage 33 having one end connected to the cutting fluid nozzles 32 and the other end connected to the cutting fluid source 35. Accordingly, the cutting fluid is not directly supplied to the cutting blade 11, but can be effectively supplied to the cutting point where the cutting blade 11 comes into contact with the workpiece W.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A cutting apparatus comprising:

holding means for holding a workpiece;

a cutting blade having a peripheral cutting edge for cutting said workpiece held by said holding means;

a spindle unit including a spindle for rotating said cutting blade;

a blade cover mounted on said spindle unit for covering said cutting blade, said blade cover having a bottom surface orthogonal to a side wall, the bottom surface covering an entire bottom of the blade cover and having a slit for allowing projection of a part of said cutting edge of said cutting blade and a suction opening formed on the bottom surface at an end of the split, a portion of the suction opening having an elliptical portion and being in fluid communication with the slit, and a plurality of nozzles provided on the bottom surface and outside said slit in the direction of a slit width for directly supplying a cutting fluid only to the upper surface of said workpiece, the nozzles being oriented towards the workpiece, with no nozzles being oriented towards the blade;

said blade cover being formed with a discharge passage having one end communicating with said suction opening in said slit and the other end communicating with a discharge opening connected to a vacuum source, said discharge passage being located in the bottom surface on a downstream side of said cutting blade;

wherein said cutting fluid supplying means includes a plurality of cutting fluid nozzles formed on said bottom surface and a cutting fluid passage having one end connected to said cutting fluid nozzles and the other end connected to a cutting fluid source;

said cutting fluid nozzles being so arranged as to form a pair of cutting fluid supply areas extending parallel to said slit on both sides thereof; and whereby said cutting fluid supplied to the upper surface of said workpiece is sucked through said slit into said discharge passage in association with the rotation of said cutting blade, and next discharged through said discharge opening to the outside of said blade cover.

2. The cutting apparatus according to claim 1, wherein said bottom surface of said blade cover is formed with an air intake passage extending from said slit to the outside of said blade cover on an upstream side of said cutting blade.

* * * * *